United States Patent [19]

Liao

[11] Patent Number: 4,745,692

[45] Date of Patent: May 24, 1988

[54] FOLDABLE ANTI-SLIP MEANS

[76] Inventor: Kuo-Chen Liao, No. 18, Yunglo Rd., Pa Shian Ts'un, Chung Liao Hsiang, Nantou Hsien, Taiwan

[21] Appl. No.: 25,034

[22] Filed: Mar. 12, 1987

[51] Int. Cl.[4] ..... A43C 15/00

[52] U.S. Cl. ..... 36/62; 36/61

[58] Field of Search ..... 36/61, 62, 59 R, 67 R; 30/28

[56] References Cited

U.S. PATENT DOCUMENTS

| | | | |
|---|---|---|---|
| 309,747 | 12/1884 | Torrence | 36/61 |
| 1,292,212 | 1/1919 | Zaun | 36/61 |
| 2,477,782 | 8/1949 | Bassett | 30/28 X |
| 2,920,403 | 1/1960 | L'etoile | 36/61 |
| 2,968,878 | 1/1961 | King | 36/61 |
| 3,447,173 | 6/1969 | Kleiman | 30/28 X |
| 3,631,614 | 1/1972 | Rice | 36/61 |

*Primary Examiner*—Stuart S. Levy
*Assistant Examiner*—Thomas Hannon
*Attorney, Agent, or Firm*—Browdy and Neimark

[57] ABSTRACT

The present disclosure is related to a foldable anti-slip device mounted at the bottom of shoes adapted for mountain-climbing and snow-walking use, which consists of a pivotable slip-proof member, outwardly exposed for effecting the purpose and retractably received in a concave recess when not needed.

3 Claims, 1 Drawing Sheet

FOLDABLE ANTI-SLIP MEANS

SUMMARY OF THE INVENTION

The present invention provides an anti-slip device which is mounted at the bottom of shoes adapted for use in mountain-climbing and walking on slippery road, and consists of a retractable slip-proof member, outwardly exposed for effecting the purpose and inwardly received when not needed.

In general, shoes have conventionally been manufactured with their bottom provided with notches of different depth so to effect an anti-slip purpose. However, most of the materials used for the bottom of shoes are plastics which lack ground-grasping capacity and become slippery against icy surfaces. To compensate for this drawback, some shoes are furnished with nail-like elements at the bottom thereof to increase the ground-grasping ability, but those elements are permanently fixed and not suitable for walking on general road surfaces.

BRIEF DESCRIPTION OF THE DRAWING

To eliminate the above-cited disadvantages, the present inventor has devoted himself to providing a foldable anti-slip device which is clearly illustrated by way of a number of accompanying drawings in which.

DETAILED DESCRIPTION OF THE PREFERRED EMBODIMENT

Figure 1:
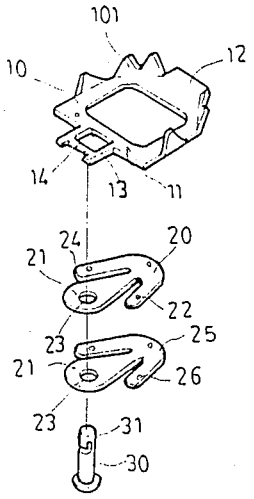
FIG. 1 is a perspective view, showing the exploded components of the present invention.

As shown in FIG. 1, the present invention consists of a base plate 25 and a fixing plate 20, both symmetrically shaped in three pronged form and having three fixing holes 26, 22, respectively planted thereon for the disposition of rivets. In this manner, the present anti-slip means can be secured to the bottom of the shoe with the sole thereof disposed therebetween. Said fixing plate 20 is structured to have a slightly upward bent press member 21 extended between its two symmetrically disposed ends, member 21 has a pin hole 23 placed at the end thereof for permitting the disposition of a pin 30 in association with the base plate 25. Pin 30 has a groove 31 planted at one side thereof for its attachment to a slip-proof member 10 when it is located with the top end thereof going through said pin hole 23. There are two outside protrusions 24 plated at the two ends of said three pronged shaped fixing plate 20, which are able to be in engagement with two apertures on said slip-proof member 10 so that the member 10 can be located in place without moving relatively to the right and left in use.

Said slip-proof member 10 is provided with protruding tooth-like elements 101, symmetrically along the two edges thereof, and a tongue 12 located at its front for ready turnover operation thereof. Member 10 also includes a pair of parallelly-disposed protrusions 13 is fixed at the opposite end thereof with a transverse member 14 disposed therebetween which is engaged in said groove 31 of the pin 30 for effecting the pivotable turnover of the slip-proof member 10.

Figure 2A:
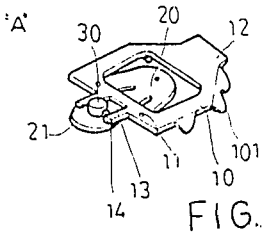
FIGS. 2*a*, 2*b*, 2*c*, and 2*d* are a number of perspective views of the operation of the present invention.
Figure 2B:
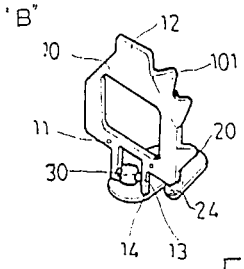
Figure 2C:
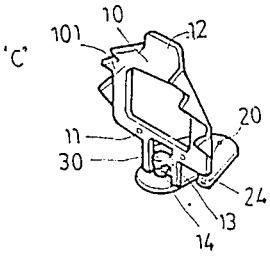
Figure 2D:
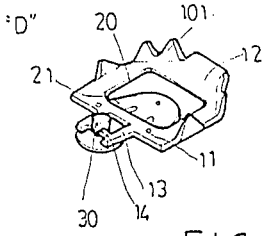
Figure 4:
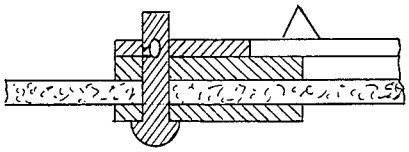
FIG. 4 is a cross-sectional view of the anti-slip device taken along line A—A of FIG. 3.
Figure 3:
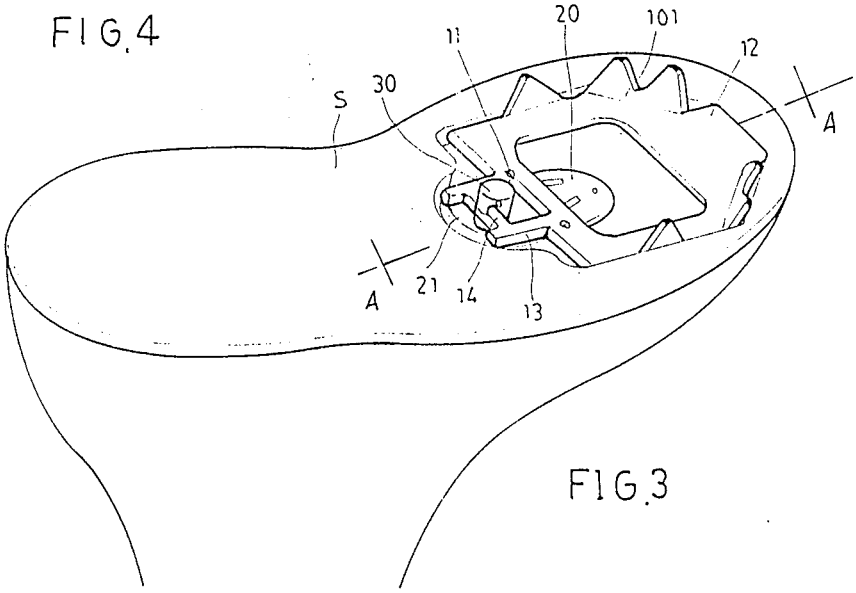
FIG. 3 is an example of the application of the present invention to the bottom of a shoe.

Refer to FIGS. 2*a*–2*d* and FIG. 3, in mounting the present anti-slip device to the bottom of a shoe, the base plate 25 is first receivingly secured at a place between the bottom and the inner of the shoe, with the pin 30 and the rivets (not shown), for joining purposes, being attached thereon, and said rivets are extended externally to such an extent that the fixing plate 20 can be fixed at the bottom of a shoe by way of said rivets. As shown in FIG. 3, the slip-proof member 10 is pivotably secured to the pin 30 by putting the transverse member 14 thereof in said groove 31. The assembled anti-slip device is able to be housed in a recess at the bottom of the shoe with its surface lying flush with the bottom of said shoe and the tooth-like elements 101 received in said concave recess for walking on a non-slippery surface. The tooth-like elements can alternatively be turned to be outwardly exposed for use against a slippery surface so as to increase the ground-grasping capacity of said shoe.

The operating procedures of the present anti-slip means are as illustrated from FIGS. 2*a*–2*d* FIG. 2*a* shows the present anti-slip device 10 being in a non-use state. The tongue 12 is actuated outwardly to put said member 10 in an erected position as shown in FIG. 2*b*. This erected position is effected as a result of the transverse member 14 disposed at one end of said member 10 being mounted in said groove 31 of said pin 30 and serving as a pivot axis. Said raised slip-proof member 10 is turned 180 degrees, as shown in FIG. 2*c*, so that the tooth-like elements outwardly exposed for use. The erected member 10 is pushed down and disposed in a horizontal manner with the tooth-like elements facing outwardly and the fixing apertures 11 are being engaged with said protrusions 24 of said fixing plate 20 as shown in FIG. 2*d*, so that the anti-slip device can be put into use in mounting climbing or walking on a slippery surface as a result of the effective ground-grasping capacity thereof.

I claim:

1. An anti-slip device for connection to a sole of a shoe, comprising, in combination:

a base plate having an approximate three-pronged form;

a plurality of rivets;

a fixing plate having an approximate three-pronged form, said base plate and said fixing plate being riveted together at a plurality of substantially equally-spaced points, the sole of the shoe being disposed between said base plate and said fixing plate;

a pin having a groove at a top end thereof, said pin being adapted to first pass through a pin hole in said base plate, then the sole of the shoe, and last through a pin hole in said fixing plate, the top end of said pin being externally exposed;

a slip-proof member having protruding tooth-like elements disposed along edges thereof, said slip-proof member being pivotably engaged within said groove by means of a transverse member positioned at an end of said slip-proof member opposite to a tongue member which is used for ready turnover operation of said slip-proof member for allowing said slip-proof member to be turned over and rotated freely; and a plurality of protrusions disposed at symmetric ends of said fixing plate for engaging with apertures provided on said slip-proof member for preventing said slip-proof member from randomly moving the right or left away from its normal position.

2. The anti-slip device according to claim 1 wherein said plurality of substantially equally-spaced points comprises three substantially equally-spaced points.

3. The anti-slip device according to claim 1 wherein said plurality of protrusions comprises a pair of protrusions.

* * * * *